United States Patent [19]

Sazdanoff

[11] Patent Number: 4,524,789

[45] Date of Patent: Jun. 25, 1985

[54] FINGER REST FOR MANICURING

[76] Inventor: Elizabeth Sazdanoff, 443 Gerald Ave., Mansfield, Ohio 44903

[21] Appl. No.: 424,146

[22] Filed: Sep. 27, 1982

[51] Int. Cl.[3] ..... A45D 29/00

[52] U.S. Cl. ..... 132/73

[58] Field of Search ..... 132/73, 885; D28/56, D28/59; D4/24; D9/436

[56] References Cited

U.S. PATENT DOCUMENTS 2,171,804 9/1939 Perez ..... 132/73

2,479,601 8/1949 Bransfield ..... 132/73

3,961,636 6/1975 Mele ..... 132/73

3,978,871 9/1976 Huston ..... 132/73

*Primary Examiner*—Gregory E. McNeill

*Attorney, Agent, or Firm*—D. Peter Hochberg

[57] ABSTRACT

A finger rest for stabilizing a finger during manicuring, having a base, walls to provide for elevation of the finger, a recessed groove for receiving the finger and a method for releasably attaching the finger rest to a nail care product bottle.

2 Claims, 18 Drawing Figures

FINGER REST FOR MANICURING

BACKGROUND OF THE INVENTION

This invention relates to bottle caps for nail care products and to apparatus for supporting one or more fingers during manicuring for facilitating the application of nail care products to the nails.

During manicure procedures, such as filing and buffing of nails and, particularly, during the application or removal of nail polish, it is important that the fingers and associated nails remain steady and separated from each other to achieve satisfactory results. If the fingers are unsteady, a common result is the application of polish or polish remover beyond the desired area. One danger resulting, in part, from unsteadiness of the fingers is potential damage to countertops and tabletops from spilling or spattering of polish or polish remover. It is also useful to have separation of the fingers until nail polish has dried to inhibit potential smearing of the polish.

The fingers may be immobilized during manicuring by resting them directly on a stable surface, such as a countertop, however, this is not entirely satisfactory. The close proximity of the nail to the adjacent surface increases the potential for applying nail polish or polish remover to that surface as well as to the nail and also inhibits the freedom of movement required to effectively file or buff nails. Thus, ideally, a finger should be elevated above the stable surface during the manicuring process.

Women typically carry manicure products, such as nail polish and nail files, with them for on-the-spot manicuring and touch-up of their nails. For this reason, it is desirable to have a small, lightweight apparatus to provide for stability and elevation of the fingernail. Additionally, a finger rest is useful only in conjunction with the nail care products, therefore it is preferable to have it detachably mounted to the nail care product bottle for ready accessibility.

Apparatus for use in manicuring procedures have been proposed, however none provide the advantages of this invention. U.S. Pat. No. 2,563,315 (Uyl) illustrates a manicure stand which is designed to hold a nail polish bottle and also has a groove for receiving a finger. U.S. Pat. No. 2,662,534 (Swartz) shows a stand for supporting fingers during the application of nail polish. This stand is quite bulky; indeed, it is large enough to receive a nail care product bottle within it in an interior cavity. Similarly, U.S. Pat. No. 3,961,636 (Mele) illustrates a finger rest with a cavity for receiving a nail polish bottle.

U.S. Pat. No. 2,656,842 (Ammarell) relates to bottles having recessed shoulders acting as finger supports. U.S. Pat. No. 2,579,450 (Lisbon) discloses finger rests that are fixably attached to the nail polish bottle. None of the above patents relate to apparatus that may be attached to the nail care product bottle, readily removed from the bottle and placed on a surface for use as a finger rest. Particularly, none of these patents relate to bottle caps which may be removed and used as a finger rest during manicuring.

SUMMARY OF THE INVENTION

This invention provides a finger rest for stabilizing fingers, and the associated nails, during the manicuring process. A finger rest according to this invention may include a bottle cap for closing a bottle, an apparatus detachably mounted to a bottle cap or an apparatus detachably mounted to other parts of a bottle. At least one recess is provided for receiving a finger, with the recess preferably having ridged indentations for inhibiting sticking or slipping of the fingers. The finger rest is provided with a base to support the finger rest on a stable surface and walls for elevating the finger rest and, thus, the finger, above the stable surface.

A finger rest according to this invention elevates and stabilizes the finger during manicuring, thus inhibiting smearing of nail polish and protecting countertops. It is compact, inexpensive to produce and adapts easily to present nail care product bottles without having to alter the design of the current packaging. It may be marketed with nail polish or polish remover, or in larger manicure sets, and is ideal for promotional and merchandising purposes.

DESCRIPTION OF THE PREFERRED EMBODIMENTS

Figure 1:
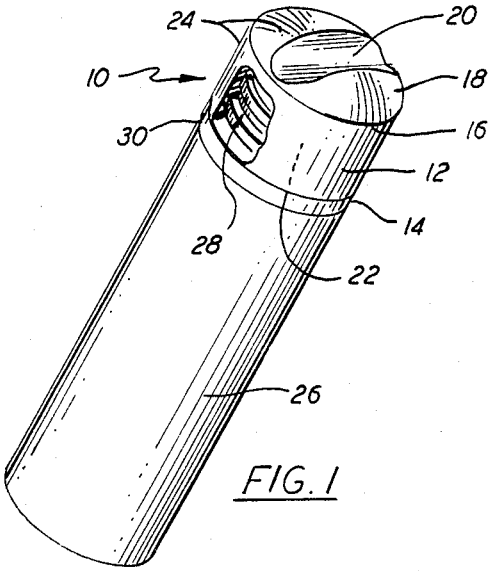
FIG. 1 is a perspective view of one embodiment of the present invention, partially in section, being a bottle cap having a recessed groove in its top surface, showing the bottle cap attached to a bottle.

Turning to the drawings, FIG. 1 illustrates one embodiment of this invention as comprising a finger rest cap 10 having a housing 24; housing 24 being defined by a cylindrical sidewall 12 and a conical surface 18. Sidewall 12 has a lower base 14 and an upper shoulder 16. Conical surface 18 is connected to shoulder 16 and includes a recessed groove 20 configured to receive a finger. Groove 20 preferably includes ridged indentations to inhibit sticking or slipping of a finger during manicuring. (Each embodiment of this invention includes a recessed groove for receiving a finger and in each case the groove preferably includes ridged indentations for inhibiting slipping or sticking of the finger).

Figure 6:
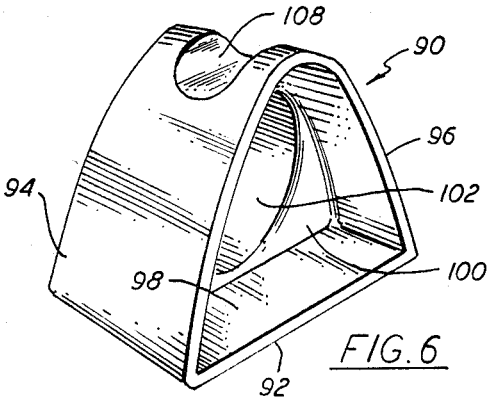
FIG. 6 is a bottom view perspective of a bottle cap attachment pursuant to a further embodiment having a recessed groove within one of its sidewalls.

Housing 24 defines an interior cavity 22 configured to receive the upper neck of a bottle 26. As illustrated in the sectional portion of FIG. 1, cavity 22 is preferably fitted with a system of threads (not shown) to screw on to a threaded portion of bottle 26 thus sealing that bottle. Alternatively, cavity 22 might be configured to snap onto the neck of a nail care product bottle, again, sealing the bottle. Cavity 22 might, instead, be configured as a hollow appropriately designed to fit snugly onto a screw cap of a nail care product bottle and providing a finger rest cap 10 that is detachably mountable to the screw cap (such a hollow is illustrated in FIG. 6). Finger rest 10 could then be removed when needed and placed on a stable surface, while the screw cap could be utilized, with an attached applicator brush, to apply polish to the nail. A space 30 is preferably provided between the finger rest cap 10 and bottle 26. Space 30 minimizes the possibility that the nail care product will come in contact with lower base 14.

Sidewall 12 in FIG. 1 is illustrated as a cylindrical sidewall, however this shape is not mandatory and other shapes are acceptable; for instance, a triangular configuration with three planar sidewalls defining a triangle or a square configuration with four planar sidewalls defining a square. (See FIG. 12, below). Surface 18 in FIG. 1 would have to be suitably reshaped to accommodate these configurations—retaining the upward slope from upper ridge 16 toward the center of surface 18 and retaining a groove 20 in that surface.

Figure 2:
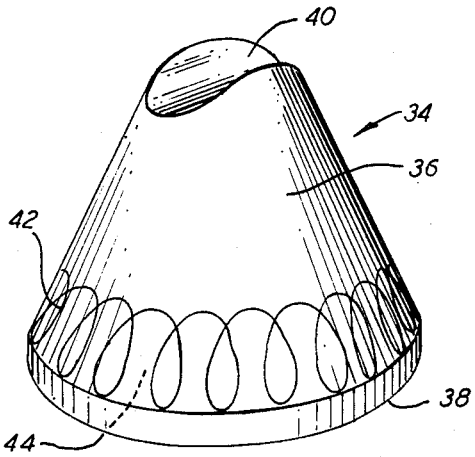
FIG. 2 is a perspective view of another embodiment of the present invention, being a bottle cap cover having a recessed groove in its top surface.

FIG. 2 shows another embodiment of this invention as comprising a bottle cap 34 with a conical sidewall 36 having a base 38 for contacting a stable surface. At the apex of sidewall 36 is a recessed groove 40 for receiving a finger. Sidewall 36 may have a decorative design such as the spiral design 42 illustrated in FIG. 2.

An interior cavity 44 is defined by sidewall 36. As in FIG. 1, the cavity may be configured to allow cap 34 to be detachably mounted to a screw cap. Alternatively, it may be fitted with a system of threads to screw onto the neck of a bottle, or it may be configured to snap onto the neck of a bottle.

Figure 3:
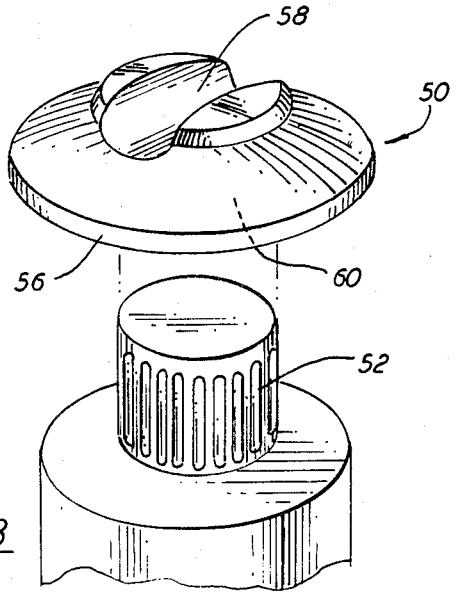
FIG. 3 and FIG. 4 are perspective views of bottle cap attachments according to another embodiment having a recessed groove in their top surfaces.
Figure 4:
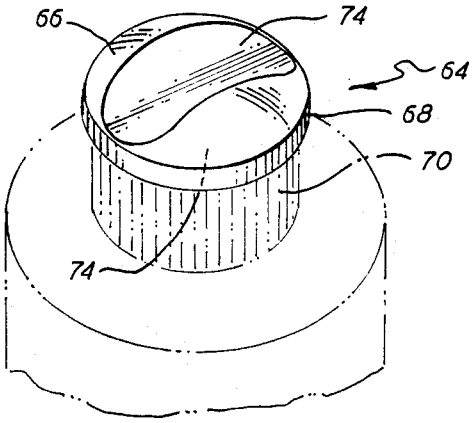

FIG. 3 and FIG. 4 illustrate other embodiments of this invention as comprising finger rest caps 50, 64 designed to be detachably mounted to a screw cap 52, 70, respectively, of a nail care product bottle. FIG. 3 shows a finger rest cap having a substantially truncated conical sidewall 54 with a base 56; the diameter of the finger rest 50 being substantially larger than the diameter of scew cap 52, thus providing greater stability for the finger rest when placed on a stable surface. A recessed groove 58 for receiving a finger is located at the apex of conical sidewall 54. As with FIG. 1, cavity 60, defined by sidewall 54 and base 56, preferably includes a hollow designed to fit snugly onto screw cap 52, allowing detachable mounting of finger rest 50 (such a hollow is illustrated in FIG. 6).

FIG. 4 illustrates a finger rest 64 according to this invention as comprising a conical sidewall 66 with a base 68 and a recessed groove 72. Sidewall 66 and base 68 define a cavity 74. The diameter of finger rest 64 is substantially equivalent to the diameter of a screw cap 70, thus cavity 74 defines a hollow allowing finger rest 64 to be detachably mounted to screw cap 70.

Figure 5:
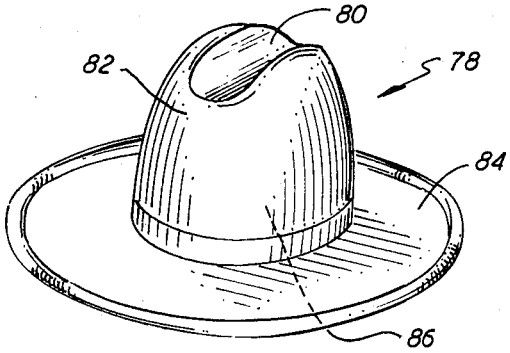
FIG. 5 is a perspective view of yet another embodiment wherein a bottle cap cover has an extended base rim and a recessed groove in its top surface.

FIG. 5 illustrates yet another embodiment of this invention as comprising a finger rest cap 42 shaped as a hat with a recessed groove 43 at the peak of a hat body 44. Brim 45 acts as a base, providing a wide table rest. As with FIG. 1, a cavity 46 is preferably configured to allow finger rest 42 to be either detachably mounted to a screw cap 47 of a nail care product bottle 48, or is provided with a screw thread system allowing finger rest 42 to be directly screwed onto bottle 48.

Figure 7:
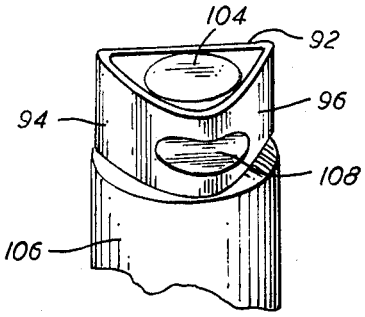
FIG. 7 is a perspective view of the bottle cap attachment in FIG. 6 affixed to a bottle and associated cap.

Another embodiment of this invention is shown in FIG. 6 and FIG. 7. A finger rest cap 90 is defined by sidewalls 92, 94, 96, the three sidewalls being substantially planar and defining substantially a triangle. Sidewalls 92, 94, 96 also define a cavity 98 containing a mounting piece 100; mounting piece 100 includes an opening 102 shaped to fit snugly onto a screw cap 104 of a nail care product bottle 106, allowing finger rest 90 to be detachably mounted on screw cap 104. A recessed groove 108 is provided at the junction of sidewalls 94, 96, with groove 108 shaped to receive a finger.

The planar outer surface of sidewall 92 is designed to be a substantially planar base for finger rest 90. With this construction it is particularly unlikely that the nail care product will contact the base formed by sidewall 92.

Figure 8:
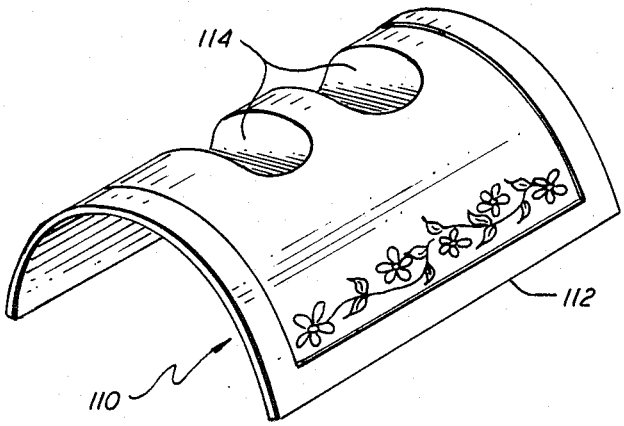
FIG. 8 is a perspective view of a manicure support apparatus according to another embodiment, having recessed grooves in its top surface when being used for manicure operation.
Figure 9:
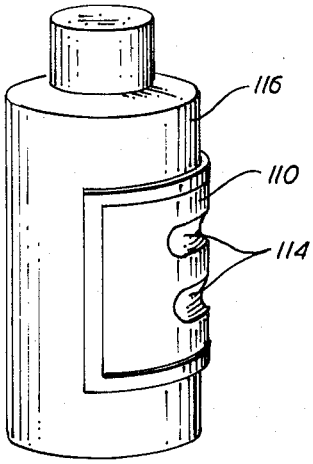
FIG. 9 is a side view of the apparatus in FIG. 8 when affixed to the side of a bottle.

FIG. 8 and FIG. 9 illustrate another embodiment of this invention as comprising a semi-cylindrical, resilient plate 110 having edges 112 defining a base for supporting plate 110 on a stable surface. Plate 110 is shown as including two recessed grooves 112, each for receiving a finger, located at the uppermost elevation of plate 110 when it rests on edges 112. Plate 110 is resilient, allowing it to be detachably clipped to the side of a nail care product bottle 116.

Figure 10:
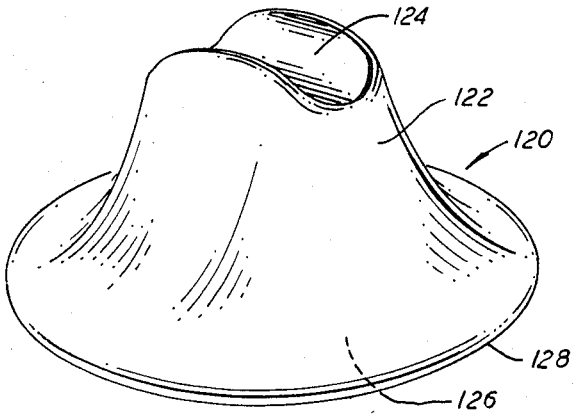
FIG. 10, FIG. 11, FIG. 12 and FIG. 13 are perspective views of various embodiments of the manicure support apparatus, all having a recessed groove in their top surfaces.
Figure 12:
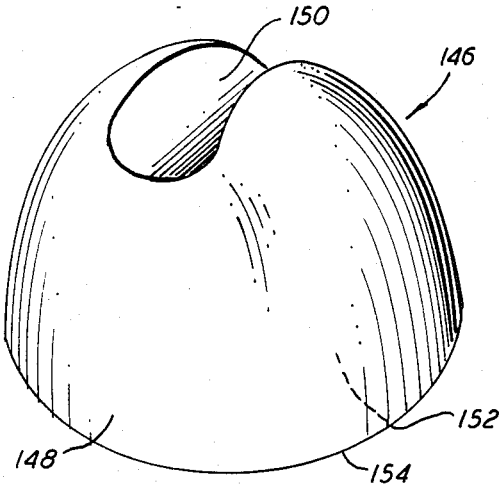
Figure 11:
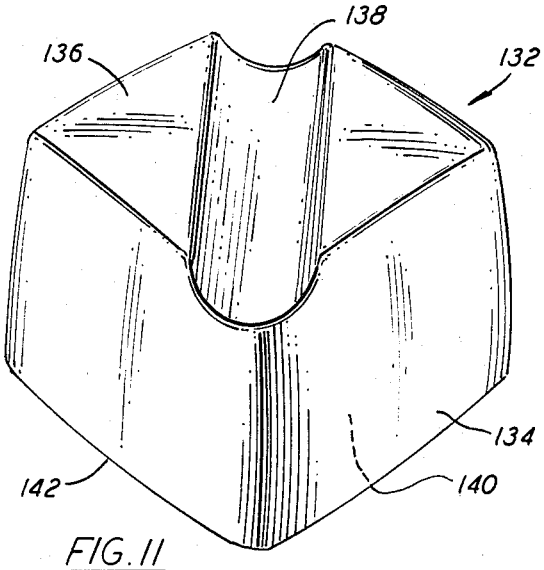

FIG. 10, FIG. 11, FIG. 12 and FIG. 13 all illustrate further embodiments of a finger rest according to this invention. FIG. 10 shows a finger rest 120 with an inwardly sloping conical sidewall 122, a recessed groove 124, and a base 128. Sidewall 122 defines an interior cavity 126. FIG. 11 illustrates a finger rest 132 having four substantially planar sidewalls 134 defining a square. Upper surface 136 includes a recessed groove 138. Sidewalls 134, having a lower base 142 for contacting a stable surface, define an interior cavity 140. FIG. 12 shows a finger rest 146 having a dome surface 148 with a recessed groove 150 at the apex of dome 148. The dome surface 148 defines an interior cavity 152 with the lower edge of dome 148 forming a base 154.

As with FIG. 1 and FIG. 2, interior cavities 126, 140, 152 of FIG. 10, FIG. 11, and FIG. 12, respectively, may be configured to receive the neck of a bottle (not shown); being fitted to snap onto the neck of a bottle or having a system of threads to screw on to a threaded portion of a bottle neck (such a thread system is illustrated in FIG. 1); instead, the cavity might be configured as a hollow allowing the finger rest to be detachably mounted to a screw cap of a nail care product bottle (such as hollow is illustrated in FIG. 6).

Figure 13:
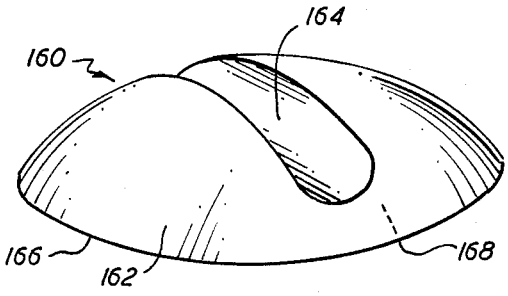

FIG. 13 shows a finger rest 160 having a low domed surface 162 with a recessed groove 164 and a base 166; domed surface 162 defining an interior cavity 168. As with FIG. 3 and FIG. 4, the low construction of FIG. 13 is more amenable for mounting to a screw cap of a nail care product bottle, thus cavity 168 is preferably configured as a hollow allowing detachable mounting of finger rest 160 to a screw cap.

The invention has been described in the above preferred embodiments with regard to particular geometric shapes, however it should be understood that other geometric shapes are also within the scope of this invention.

Figure 14:
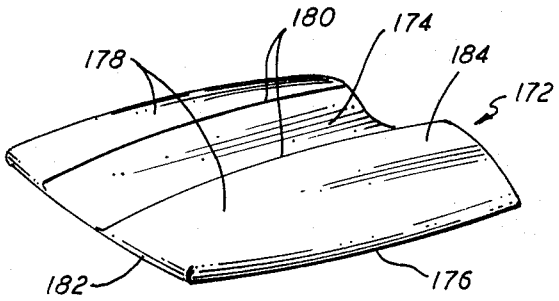
FIG. 14, FIG. 15 and FIG. 16 are perspective views of various embodiments of the manicure support apparatus, all having an elongated groove or channel in their top surfaces.
Figure 15:
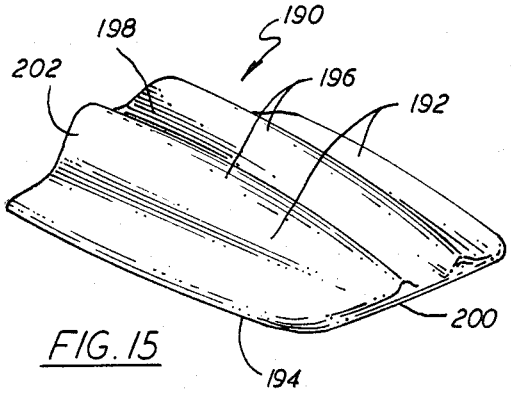
Figure 16:
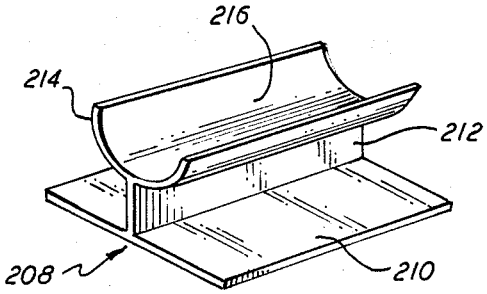

FIG. 14, FIG. 15 and FIG. 16 illustrate further embodiments of this invention; which embodiments are not designed to be attached to a bottle. FIG. 14 shows a finger rest 172 having a recessed groove 174, a base 176, and sidewalls 178. Groove 174 has shoulders 180 connecting it with sidewalls 178. Shoulders 180, base 176 and sidewalls 178 meet at a front edge 182, with shoulders 180 sloping upwardly towards a backwall 184. Except at front edge 182, sidewalls 178 slope convexly from base 176 upwardly to shoulders 180. FIG. 15, illustrating a finger rest 190, is similar to FIG. 14 except that sidewalls 192 slope concavely from a base 194 upwardly to shoulders 196 of a recessed groove 198. As with FIG. 15, shoulders 192 slope upwardly from a front edge 200 to a back wall 202, with sidewalls 192, shoulders 196 and base 194 meeting at front edge 200. In FIG. 16 a finger rest 208 is shown as comprising a base plate 210 with a support 212 perpendicular to base plate 210. Fixably mounted on support 212 is a semi-cylindrical plate 214 mounted such that the open portion of plate 214 forms a recessed groove 216 for receiving a finger. Finger rests 172, 190, 208 are preferably provided with felt bottoms to further protect the stable surface on which they are placed.

Figure 17:
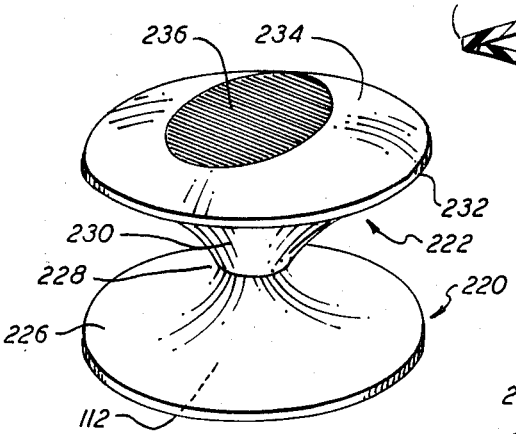
FIG. 17 is a perspective view of one embodiment of a manicure support apparatus having a recessed groove in its top surface and a rotational device between the top surface and the base.
Figure 18:
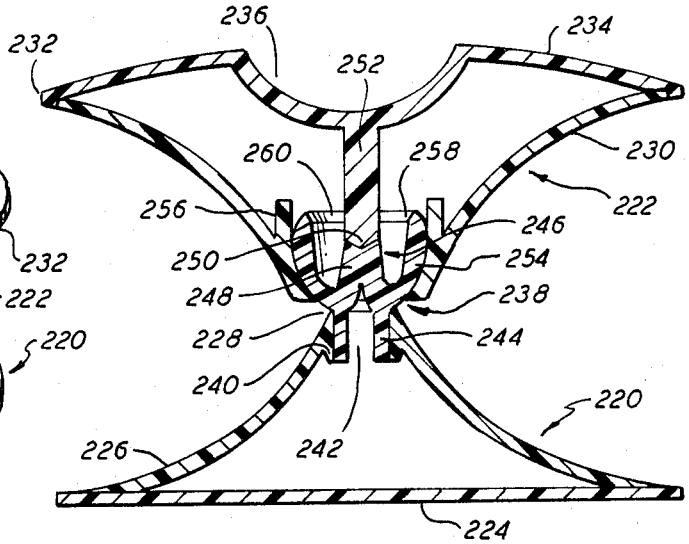
FIG. 18 is a cross-sectional view of the manicure support apparatus in FIG. 17, showing the interior rotational device.

FIG. 17 and FIG. 18 illustrate a further embodiment of this invention as comprising a swivel-mounted finger rest. This finger rest is shown as comprising a base section 220 and a rotating upper section 222 on which a finger may rest. Base 220 has a contact surface 224 and a conical sidewall 226; sidewall 226 sloping upwardly and inwardly from its widest point, at surface 224, to its narrowest point at junction 228. At junction 228, base 220 is joined to rotating upper section 222 in a manner described below. Preferably, contact surface 224 has a felt bottom to further protect a stable surface.

Upper section 222 includes conical sidewall 230 which sidewall slopes upwardly and outwardly to an upper shoulder 232, with sidewall 230 defining basically an inverted cone. At shoulder 232, sidewall 230 is connected with a top surface 234 which has a substantially low-domed configuration. Surface 234 includes a recessed groove 236 for receiving a finger.

FIG. 18 illustrates a rotational device 238 for connecting base 220 with rotating upper section 222, allowing upper section 222 to rotate with respect to base 220. Base 220 includes a cylindrical recess 240 with a post 242. A cylinder 244 of rotational device 238 is mounted on post 242. A support base 246 is formed by a conical wall 248 rising upwardly and inwardly from cylinder 244. A depression 250 receives the lower portion of a support post 252; which post depends from the lowermost point of groove 236. For lateral support, device 238 is provided with a substantially cylindrical wall 254 rising upwardly and outwardly from cylinder 244; said cylinder wall 254 contacting a substantially cylindrical support member 256, part of upper section 222, configured to receive cylinder 254. A contact surface 258 of wall 254 contacts a flange 260 of support post 252.

The swivel action of this embodiment of the invention allows the user to move her finger forward, backward or to either side with ease. This finger rest is particularly suited for use in a beauty salon, for it may assist a manicurist by providing ease of movement of the patron's finger.

A finger rest according to this invention is preferably constructed of plastic, metal, ceramics or other suitable material. Preferably it is constructed as a single piece (except as in the embodiment of FIGS. 17, 18 which have movable parts), plastic being ideally suited for molding in this manner. Stamped metal pieces are also satisfactory.

This invention has been described in detail with particular emphasis on the preferred embodiments, but it will be understood that there are modifications and variations within the scope of the invention.

What is claimed is:

1. A finger rest for stabilizing and elevating a finger during manicuring, said finger rest comprising closure means for covering and sealing the opening of a nail care product bottle having a generally planar base, said closure means having opposed top and bottom surfaces and an interior surface, said bottom surface receiving said bottle opening, said interior surface frictionally engaging the bottle to seal the opening, and said top surface having at least one concave groove oriented generally parallel to the planar base for receiving a finger.

2. A finger rest for stabilizing and elevating a finger during manicuring, said finger rest comprising: engaging means for frictionally engaging the cap of a nail care product bottle, said engaging means having opposed top and bottom surfaces, said bottom surface receiving said bottle cap, and a side surface generally transverse to said top and bottom surfaces, said side surface having at least one concave groove for receiving a finger.

* * * * *